US006390438B1

(12) United States Patent
Mc Manus

(10) Patent No.: US 6,390,438 B1
(45) **Date of Patent: *May 21, 2002**

(54) END LATCH FOR REMOVABLE SUPPORT FOR CONCRETE SLAB CONSTRUCTION AND METHOD

(76) Inventor: Ira J. Mc Manus, 39 Lincoln Ave., Florham Park, NJ (US) 07932

( * ) Notice: Subject to any disclaimer, the term of this patent is extended or adjusted under 35 U.S.C. 154(b) by 0 days.

This patent is subject to a terminal disclaimer.

(21) Appl. No.: 09/564,661

(22) Filed: May 3, 2000

(51) Int. Cl.[7] ..... E04B 1/18; E04G 11/36; E04G 17/16

(52) U.S. Cl. ..... 249/19; 249/23; 249/24; 249/211; 52/354; 52/360; 52/745.06

(58) Field of Search ..... 249/19, 23, 24, 249/25, 188, 210, 211; 52/354, 355, 359, 360, 742.14, 745.06

(56) References Cited

U.S. PATENT DOCUMENTS

| | | | | | |
|---|---|---|---|---|---|
| 644,986 | A | * | 3/1900 | Lechner | 249/24 |
| 1,707,420 | A | * | 4/1929 | Wales | 249/19 |
| 2,202,096 | A | * | 5/1940 | Dell et al. | 249/210 X |
| 3,059,738 | A | * | 10/1962 | Lutz | 249/210 X |
| 3,841,597 | A | * | 10/1974 | Butts et al. | 249/210 X |
| 3,890,750 | A | * | 6/1975 | Berman et al. | 249/19 X |
| 3,954,248 | A | * | 5/1976 | Barber | 249/211 |
| 3,993,282 | A | * | 11/1976 | Berman et al. | 249/24 |
| 4,123,031 | A | * | 10/1978 | Hyre | 249/24 |
| 4,335,557 | A | * | 6/1982 | Morton | 52/745.05 |
| 4,348,002 | A | * | 9/1982 | Eyden | 249/19 |
| 4,856,252 | A | * | 8/1989 | Cornell | 249/23 X |
| 5,906,076 | A | * | 5/1999 | McManus | 249/23 X |

FOREIGN PATENT DOCUMENTS

| | | | | |
|---|---|---|---|---|
| AU | 147001 | * | 6/1952 | 249/24 |
| AU | 150497 | * | 3/1953 | 249/19 |
| CH | 208310 | * | 3/1939 | 249/19 |
| GB | 27590 | * | 12/1906 | 249/23 |
| GB | 479594 | * | 2/1938 | 249/210 |
| GB | 487218 | * | 6/1938 | 249/23 |
| JP | 4-85458 | * | 3/1992 | 249/211 |

* cited by examiner

*Primary Examiner*—Laura A. Callo
(74) *Attorney, Agent, or Firm*—W. Patrick Quast, Esq.

(57) ABSTRACT

A removable support structure for concrete slab fabrication is described. A horizontally length adjustable latch device may be secured to both ends of shoring girders or shoring beams, or to just one end with a fixed in place latch secured at the other end, to permit rapid and accurate placement of the shoring support across a span to be structured in concrete. Vertical shoring posts and supports are eliminated, with the added advantage of the plane of the shoring always being automatically in the plane of the floor being formed. Bearing shoes on the ends of corrugated deck members, secured to building girders, cooperate with straps at their other ends, accurately and securely positions the corrugated decking in place. After the concrete has hardened, the entire support structure, including the shoring girders, shoring beams, and corrugated deck members, are rapidly and efficiently removed, ready for re-use.

12 Claims, 10 Drawing Sheets

END LATCH FOR REMOVABLE SUPPORT FOR CONCRETE SLAB CONSTRUCTION AND METHOD

BACKGROUND

This invention relates to the construction of concrete slabs, and in particular to a support structure that is rapidly and efficiently put in place, and rapidly and efficiently removed in condition for reuse.

Concrete slab construction is, of course, a routine method for horizontally covering open areas between columns and girders affixed to the walls of buildings, parking garages, and so on. A typical procedure for installing these concrete "floors" is to first place shoring members across the columns and girders, with shoring support posts rising from the ground or the deck below to the concrete floor being installed. Corrugated decking is then placed on the surface of the shoring, with the edges of the decking overlapping flange edges on the permanent building wall, girders and columns. Post-tensioning steel cables are then placed over the decking to add strength to the resultant structure. Conventional reinforcing bars can be used as well. Wet concrete is then poured over the corrugated decks. The concrete is then allowed to harden over a period of time. The supporting members can be so designed as to be removable after the concrete has hardened, simplifying concrete slab maintenance, and permitting re-use of the support structure on additional floors.

Various methods have been proposed for removable concrete slab support systems as is evident from the following examples. Keppler, in U.S. Pat. No. 1,707,226, discloses a supporting structure for concrete construction. This invention teaches a height adjustable shore 12 (centering post) cooperating with flanged 18 sheet metal members 16 (corrugated decking) connecting to height adjustable recesses 21 in soffit chairs. The invention notes (col. 2, lines 01–109), "after the concrete has been sufficiently set, the shoring may be removed and the ledgers taken down, whereby the centering forms with the soffit chairs may be removed and permanent shoring mounted in place to engage the soffit plates or boards for continuing to support the concrete until it is firmly set with full strength". Lutz, in U.S. Pat. No. 3,059,738, discloses a removable concrete slab support wherein a portion of the support may be removed for the sake of economy prior to the concrete being fully set. An intermediate support 2 upheld by a prop 3 holds concrete slab supporting girders 1 and end supports 4 in place during the initial phase of setting wet concrete. Cornell, in U.S. Pat. No. 4,856,252, discloses a joist hanger 10 for removably securing a joist 38 during concrete slab construction. The joist hanger 10 has a box like metal configuration for securing the end of a suitable joist in the hanger. The joist hanger 10 has an extension section 18 for overlapping the top surface of a wall or girder 52, with a roll bar 22 acting as a pivot located a spaced distance below the extension section. After a concrete slab 34 is solidified on as suitable support 36, a sharp blow to the hanger causes it to pivot on roll bar 22, thereby releasing the hanger 10, joist, and support form the hardened concrete slab.

While these devices and methods disclose useful details for installation and removal of concrete slab support systems, they do not envision the efficiencies and conveniences inherent in the present invention. As will be more fully discussed below, this invention discloses a removable structure and method for supporting wet concrete during concrete slab construction without making use of vertical posts or shoring members which have to be supported down through the floors below to the ground. Accurate set up of corrugated decks is quickly accomplished to accept wet concrete. After the concrete has hardened all support members are quickly removed, ready for re-use as required.

It is therefore a primary object of the invention to provide a removable structure for supporting concrete slab construction that can be quickly put in place prior to the pouring of wet concrete, and quickly removed in re-usable condition after the concrete has hardened.

A further object of the invention is to eliminate the necessity for using vertical posts or shoring members which would have to be supported down through the floors below to the ground.

Another object of the invention is to permit the pouring and forming of a number of levels of concrete slabs in any desirable sequence.

Still another object of the invention is to provide for the plane of the shoring to always be automatically in the plane of the floor being formed.

A further object of the invention is to eliminate the necessity for permanently affixing structural support members to each other.

An additional object of the invention is to provide for most efficient placement of steel tendons within the concrete if post tensioning reinforcement concrete slab production is employed.

SUMMARY

In my application Ser. No. 09/041,944, filed Mar. 13, 1998, which is now U.S. Patent No. 5,906,076, the disclosure of which is hereby incorporated by reference, I describe a removable support for concrete slab construction and method which achieves the above mentioned objectives and others. The above mentioned U.S. Patent disclosed vertically and laterally adjustable latches affixed to ends of shoring girders and shoring beans for quick connection to pre-cut holes in permanent building girders and columns, and shoring girders and shoring beams. Bearing shoes on a first end of corrugated decks cooperate with locking straps at a second end of said decks to complete the structural elements of the invention.

I have now discovered that the removable support for concrete slab construction in my application Ser. No. 09/041,944, filed Mar. 13, 1998, now U.S. Pat. No. 5,906,076, can be improved by replacing the disclosed vertically and laterally adjustable latches affixed to appropriate ends of shoring girders and shoring beams with latches which can be extended horizontally forward away from or retracted towards the ends of said shoring girders and shoring beams as will be more fully described below.

In building construction, concrete floors are routinely installed horizontally between permanent building columns and girders supporting the walls of the building. Wet concrete is poured over usually temporary corrugated decking erected between the building girders and columns. Typically shoring posts are required, the posts extending vertically from the ground or previously formed floor, in order to support the temporary shoring. For a variety of reasons, including economy in building construction and ease of maintenance of the finished building, removal of the corrugated decking, temporary shoring, and vertical post supports is desirable.

I have found that concrete floors can be constructed faster and more efficiently by eliminating any necessity for temporary vertical shoring supports. This permits forming floors at any convenient level without concerns regarding foundation supports for temporary shoring. In addition, my method provides for precise, accurate placement of temporary supports in that when all elements are positioned they are all in their proper location with minimal field measuring or adjusting.

For example, my method makes use of a right angle grid of shoring girders and shoring beams positioned between the permanent steelwork comprising the building columns and girders. The shoring girders and shoring beams can be constructed from conventional steel "I" beams with their ends modified with a latch device which allows insertion into a support for quick erection, adjustment, and removal. The purpose of the shoring girders is to provide support for the shoring beams, with the shoring beams providing the support for the corrugated decks. Conventional corrugated decking is employed with the exception that the ends of the decking to be supported by the building "I" beams have a bearing shoe added to the closed end of the corrugated decking to facilitate removal from the hardened concrete with will be more fully described below. The bearing shoe also prevents vertical displacement of the decking due to wind and other construction forces. The bearing shoe further allows exact bearing length of the decking over the building girder. Locking straps, placed at the opposite end of the decking to be supported by the shoring beams, complete the precise, accurately secured concrete slab construction support system.

To construct a concrete floor, the end latches on the shoring girders are secured in pre-cut holes in the permanent building girders and/or columns. Latches on at least one end of each shoring girder or shoring beam are affixed to the end of each support member by means of an adjustable shear plate. The shear plate can be moved a spaced distance forward or backward in relation to the length of the shoring girder or shoring beam, thereby permitting horizontal length adjustment between the latch and the building girder, column, or shoring beam. The latch affixed to the other end of the shoring girder or shoring beam can be similarly adjustable lengthwise, or the latch can be simply permanently secured by means of bolts or welds. Similarly shoring beams are quickly secured at right. angles to the shoring girders again making use of pre-cut holes in the shoring girders to which the end latches on the shoring beams are secured. Corrugated decking is then positioned perpendicular to and between the permanent girders and the shoring beams, with the bearing shoe end of the deck engaging a top flange edge of the permanent girder, and with the opposite end of the deck, overlapping the end of a second corrugated deck, and being held in position by locking straps, all supported by the shoring beams. The locking straps secure the open ends of the decking together, and also insure that the bearing shoe end of the deck is held firmly in place against movement caused by workers or the elements, as well as facilitating removal of the decking.

With the removable support structure now quickly, accurately, and firmly in place the wet concrete can be poured onto the surface of the corrugated decks with reinforcement rods inserted, if required. For those applications requiring post tensioning of the concrete, steel tendons can now be placed not only above the furrows of the decking, but also within the furrows. The more favored placement of steel tendons is possible here where the decking is secured perpendicular to the permanent girders, and not parallel thereto, which is typical in existing concrete slab construction. After the concrete has hardened sufficiently to be self supporting, the complete removable support structure is quickly removed, all components being ready for re-use. The latch mechanism on the shoring girders and shoring beams is removed after restraining bolts are removed, by simply hammering from the opposite side or by prying from the tab side. Latches are designed with a sloped end so that once the latch moves beyond the flat section of the connecting support member, the sloped surface helps to remove the latch and drop the shoring girder or shoring beam. The bearing shoe construction now permits the decks to be quickly removed from the cured concrete by simply lowering the open ends and rocking them in a downward direction, which movement can be facilitated by making use of the locking straps which had previously been holding the decks in place. The shape of the shoe end allows the rocking motion to break the deck free of the hardened concrete.

Thus a new convenience in forming concrete slabs in buildings, parking garages, and the like is disclosed. A wet concrete support structure is described which is set in place with heretofore unobtainable speed and efficiency. Vertical support posts for the shoring are completely eliminated, permitting flooring levels to be constructed in any convenient sequence, while at the same time assuring that the shoring is always automatically in the plane of the floor being formed whether level or on a slope as in ramped floors. The perpendicular placement of the corrugated decks also permits placement of post tensioning steel tendons in the most favored position for strengthening the concrete. While the shoring girders and shoring beams have been described as preferably being modified steel "I" beams, it is to be noted that other shoring materials, including wood, plastic, and concrete, can be similarly employed.

DETAILED DESCRIPTION

Figure 1:
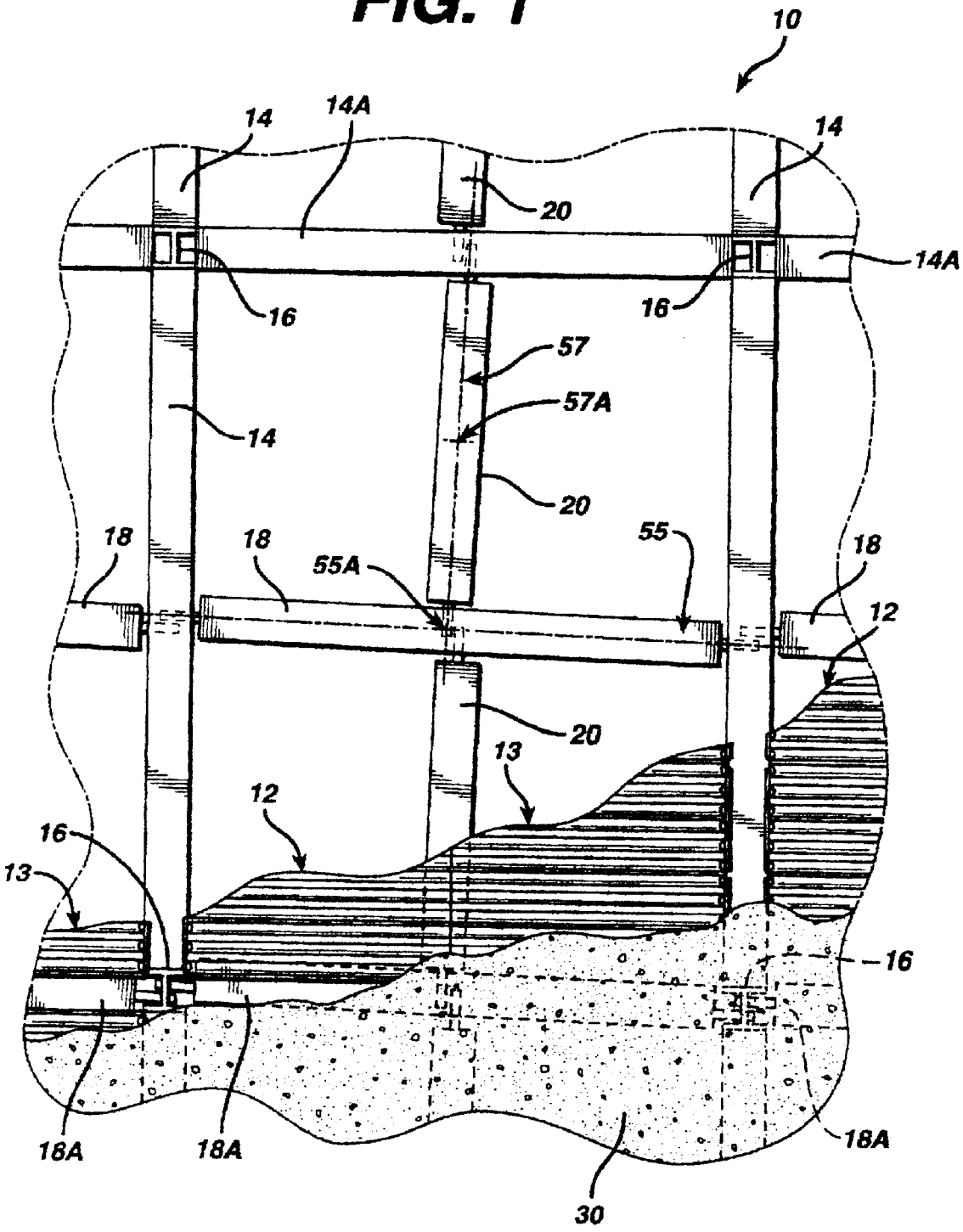
FIG. 1 a schematic representation of a floor framing plan for one version of the invention.

Turning now to the drawings wherein like structures having the same function are referred to with the same numerals, in FIG. 1 a floor framing plan 10 according to the invention is shown. Building columns 16 and girders 14 form the permanent structural elements for holding up the walls of a building, parking garage, and the like. Shoring girders 18 are shown schematically as spanning the horizontal distance between oppositely positioned building columns 16, or girders 14. Shoring beams 20 also shown schematically interconnect the shoring girders 18, and are spaced approximately equidistant and parallel to the girders 14, spanning between the opposed walls of the building. Reference numerals 14A and 18A show permanent and shoring girder members positioned between respective columns 16. Either can be used as the concrete support system design dictates. The shoring girder design, 18A, similar to shoring girder 18, has a suitable interface at each respective column to accept the latch portion of the latch engaging means as described generally hereinafter.

Corrugated decks 12 are shown positioned perpendicular to the permanent girders, with one end of each deck being supported by a shoring beam 20, and the other end being supported by the top flange of a permanent girder or a plate attached to the top of a column. The number of individual corrugated decks is obviously not limited to two to span the entire distance between building walls. Intermediate sections of decking can be employed depending on particular building dimensions. The shoring girders and shoring beams of the invention can be standard, I-beam, steel building girders modified to have a latch device at each end as will be fully described. These shoring support members can also be fabricated in wood, plastic, or concrete. Standard steel corrugated decks can be employed as support members of the invention, modified to have a closed end 22 (FIG. 2) with bearing shoe structure 23 as will be more fully discussed.

Figure 2:
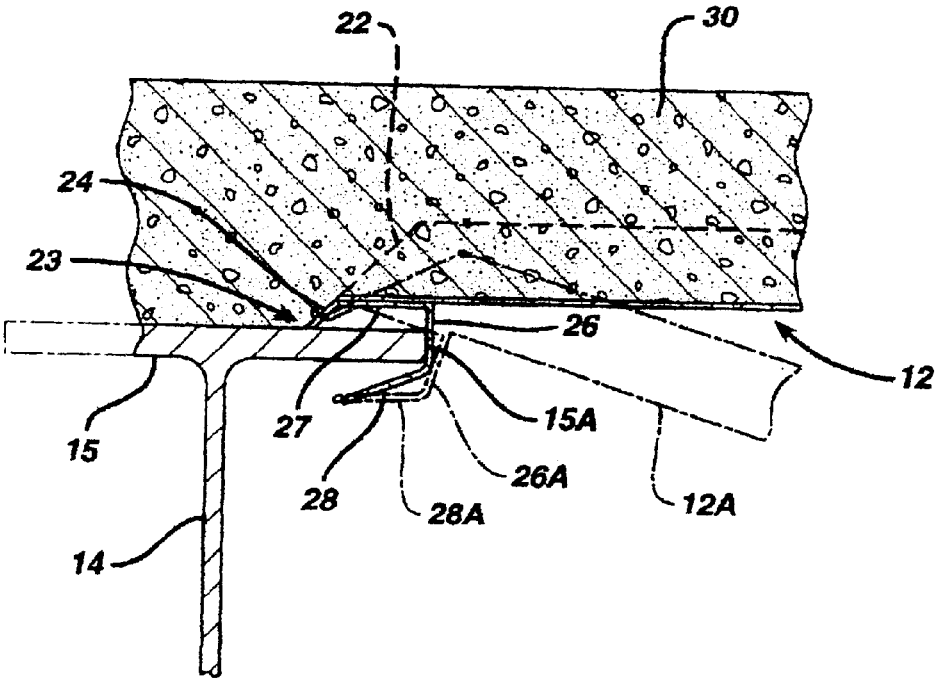
FIG. 2 is a side elevational view of one version of the invention showing the bearing shoe modified end of a corrugated deck in contact with the top flange of a permanent building girder.

In FIG. 2 the end of the corrugated deck 12 that rests on the building girder 14 is shown. Concrete 30 has been poured and hardened on the surface of the corrugated deck. Typical decks employed are normally longer in length than in width and will be so considered for the discussion of this invention. The upraised end portion adjacent each furrow 25 (see FIG. 11) at this end of the deck has a metal closure plate 22 to prevent passage of concrete through the open end to avoid encasement of the deck in concrete.

A bearing shoe 23 is affixed along the width of this end of the deck and secured to its underside. It contacts a top flange 15 of a building girder. The bearing shoe is comprised of four segments: a first segment 24 angled downward from the deck underside and contacting the top surface of the flange 15; a second segment 27 affixed to the underside of the deck immediately adjacent the closed end of the deck; a third segment 26 extending downward in a generally perpendicular direction t o the second segment 27, to a point just about even with the underside of the flange; and a fourth segment 28 extending under the flange 15 at an obtuse angle to the third segment. The purpose of this bearing shoe structure is to provide a means for raising the front end of the corrugated deck 12 above the top surface of the top flange 15 of the building girder to facilitate the deck's subsequent removal; and to provide a means for grasping the extended lateral edge 15A of the flange so as to accurately secure the decking in position, ready to accept the pouring of the wet concrete and to prevent accidental dislodgment by workers or the elements.

The straps 34 (FIG. 3) employed at the open, opposite end of a deck, which will be fully explained hereinafter, further insure the accurate, rigid deployment of the corrugated decks. After the concrete has hardened, the deck itself is not encased by the concrete. In FIG. 2, the deck 12A shown in phantom, together with third and fourth bearing shoe segments, 26A, 28A, shown also in phantom, illustrate the ease with which the corrugated decking 12 can be removed after the concrete has hardened by simply pivoting about the contact surface between first segment 24 and the top of the flange while rocking the deck in a downward motion.

Figure 3:
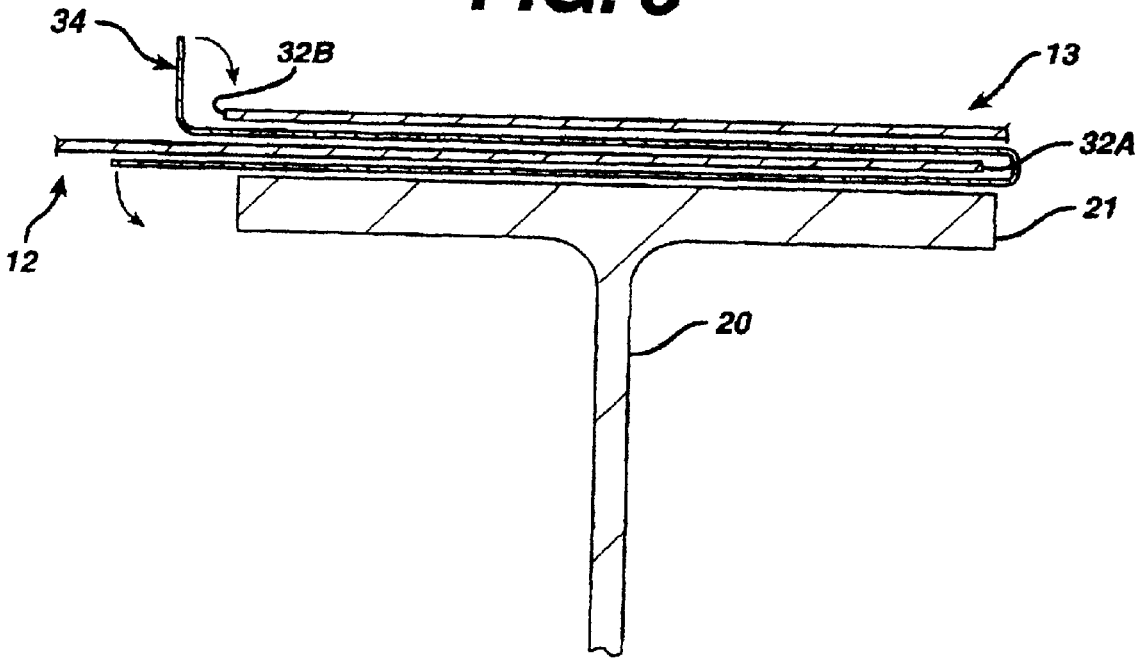
FIG. 3 is a side elevational schematic view of one version of the invention showing a strap securing the open ends of corrugated decks together.
Figure 4:
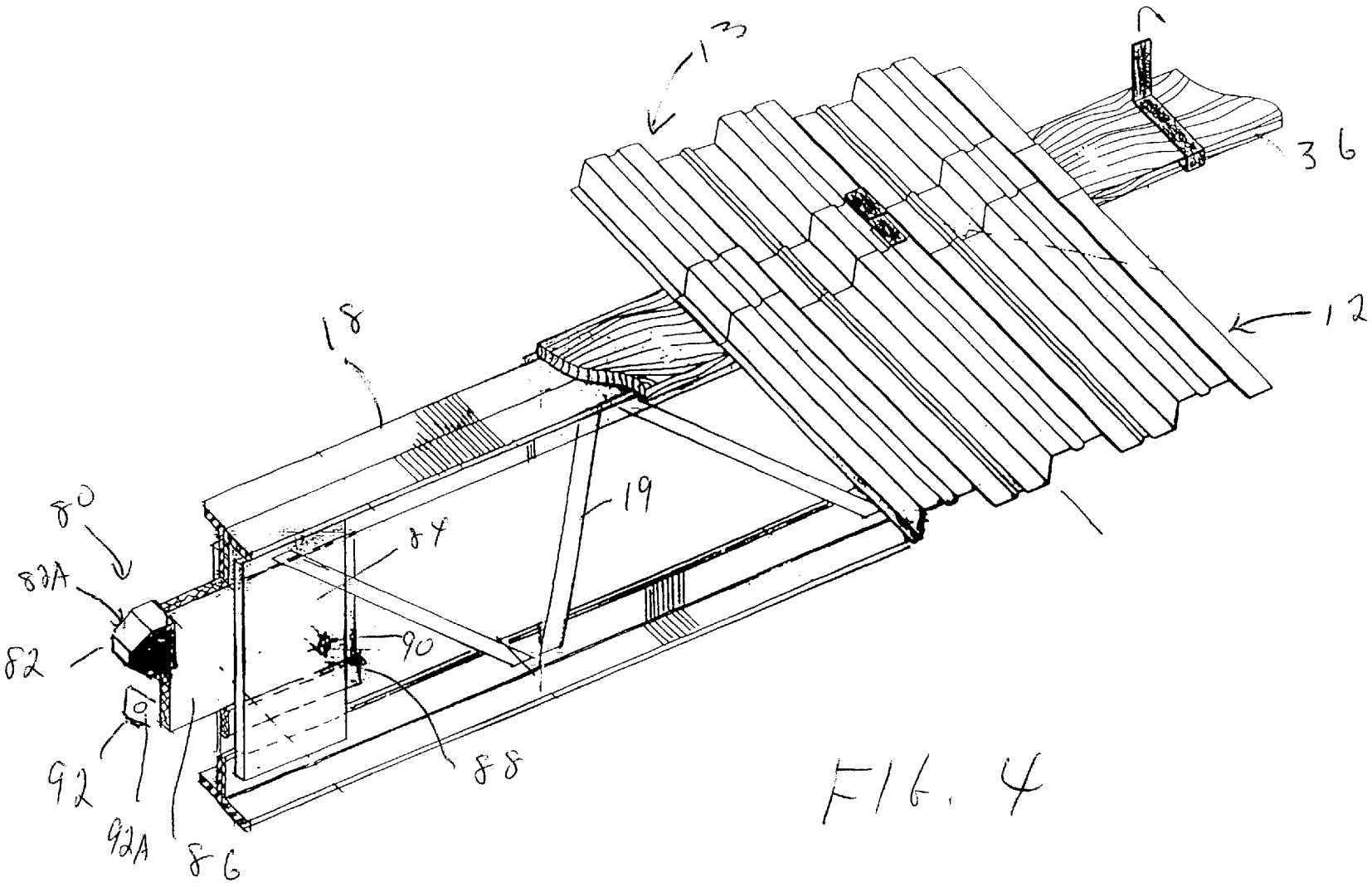
FIG. 4 is a fragmentary, top plan view of one version of a first latch device of the invention attached to one end of a shoring girder.

FIGS. 3–4 illustrate the strap securing method of the invention for connecting the open ends of the corrugated decks together where the decks 12, 13 overlap the shoring beams 20. In FIG. 3 a strap 34 is shown securing a first deck 12 in contact with the top surface of flange 21 of a shoring beam 20 to a second deck 13 extending in the opposite direction, and positioned at its open end directly over the first deck. The ends of the strap 34 are shown before they are bent in a downward direction as indicated by the arrows, thereby linking the two open ends 32A, 32B, of the two decks together. Straps 34 can be made out of metal or plastic, sheet metal being preferred for its combination of strength and bendability. The straps are a few inches in width so as to fit into the furrows 25 of the corrugated decks, and of appropriate length so as to securely link the decks together. Usually one strap per deck pairing would be used, with the strap pre-hooked so as to engage the first deck 12 before the second deck unit is placed over the first deck. Before it is hammered in place to lock the decks together, the operator pulls on the strap so as to urge each deck 12, 13, away from supporting beam 20. This procedure keeps the bearing shoe end of the deck firmly and accurately secured on its girder flange 15 or column plate, and prevents dislodgment during construction due to workmen's activities, the elements, etc. The strap also assists in deck removal since the lower end of the strap can be grasped to pull the deck downward for removal.

FIG. 4 illustrates utilizing a wooden platform 36 placed on the top level surface of a top flange 21 of a shoring beam for providing a platform for the placement of the open ends of the decking. The wood platform 36 comprises one or more piece(s) of plywood stacked on top of each other. The platform extends in width just beyond the top flange 21, thus providing a larger contact surface beneath the decking for a more stable condition. Further the wood is not as slippery as steel-on-steel when the decking is placed directly on the flange. Also, self-tapping screws can be used to secure corners, etc. of the decking down to the wood. Still further with the use of an appropriate thickness for the plywood piece(s), the height of the decking at the bearing shoe end 23 above the building girder top flange is compensated for at the shoring girders. As a result, the cooperating elements of the latching device disclosed hereinafter will lie essentially in the same plane. This facilitates the fabrication of substantially similar, support structure members, since the latch receiving openings are identically located in relation to the horizontal datum.

FIG. 4 also illustrates one version of the latch device 80 of the invention. The latch device is shown affixed to one end of a shoring girder 18. The latch device 80 is comprised of two capture plates 84 affixed to opposite sides of one end of the shoring girder. This leaves a space between the plates 84 and the web angles 19 comprising the web structure of the shoring girder 18. A bar 88 is affixed in place between the capture plates to maintain the clear space for the shear plate, and also to give the shear plate a surface to bear against when it takes up a load. A latch 82 is affixed to the end of the shear plate facing away from the end of the shoring girder, the latch 82 being wider than the shear plate 86 to provide a greater bearing surface onto the web hole 94 (FIG. 5) to which it is to be connected, and also to allow for vertical fillet welds (not shown) on each side of the shear plate. The latch 82 has a sloped end portion 82A to facilitate removal after concrete pouring and hardening as will be more fully explained. A tab 92, having a bolt hole 92A approximately at its center, is affixed to the latch end of the shear plate in order to provide a bolted connection of the shear plate 86 to the permanent building girder 14 (or another shoring beam 20). This tab plate 92 also stabilizes the girder or beam against rotation during pouring of the concrete slab. In order to provide for horizontal movement of the latch 82 forward or rearward in relation to the end of the shoring girder 18, a hole 98 is provided in the capture plate 84 which matches a slotted hole 100 in the shear plate. The effect of this version 80 of the latch device is to permit extension or retraction of the latch device over a spaced distance in a horizontal direction, thereby extending or shortening the length of the shoring girder or shoring beam as circumstances require. Once the proper setting is obtained a bolt 90 (FIG. 4) is inserted through the hole 98 in the capture plate 84 and the slotted hole 100 in the shear plate with a nut (not shown) securing bolt 90 in the appropriate position. In the case of shoring girder 18 having web angles 19 forming the web structure of the support member, the shear plate 86 is free to slide between the web angles. In the case of a solid web structure best seen in FIG. 6, a space 102 is cut out of the web structure to permit lateral movement of the shear plate 86 along the spaced distance.

Figure 5:
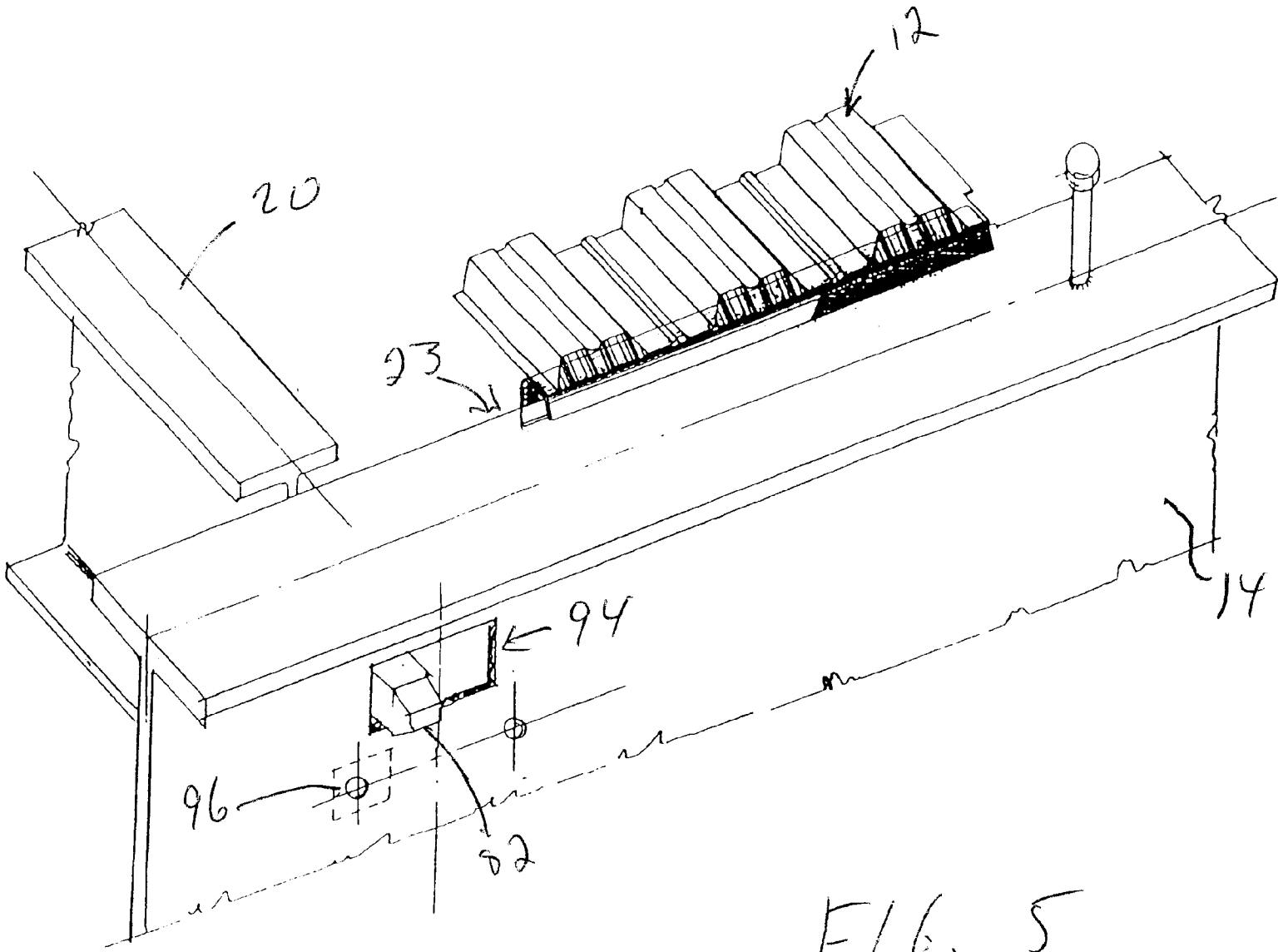
FIG. 5 is a fragmentary, top plan view of one version of a first latch device of the invention at one end of a shoring beam being connected to a permanent building girder.

In FIG. 5 a permanent building girder 14 is shown supporting a corrugated deck 12. The bearing shoe channel 23 affixed to the end of the corrugated deck is shown overlapping a top flange portion of the girder. A pre-cut latch securing hole 94 accommodates a latch 82 affixed to the end of a shoring beam 20. Precut bolt holes 96 at the lower left and right of the latch securing hole match bolt holes 92A in the tab plate 92 affixed to each one of the shear plates.

Figure 6:
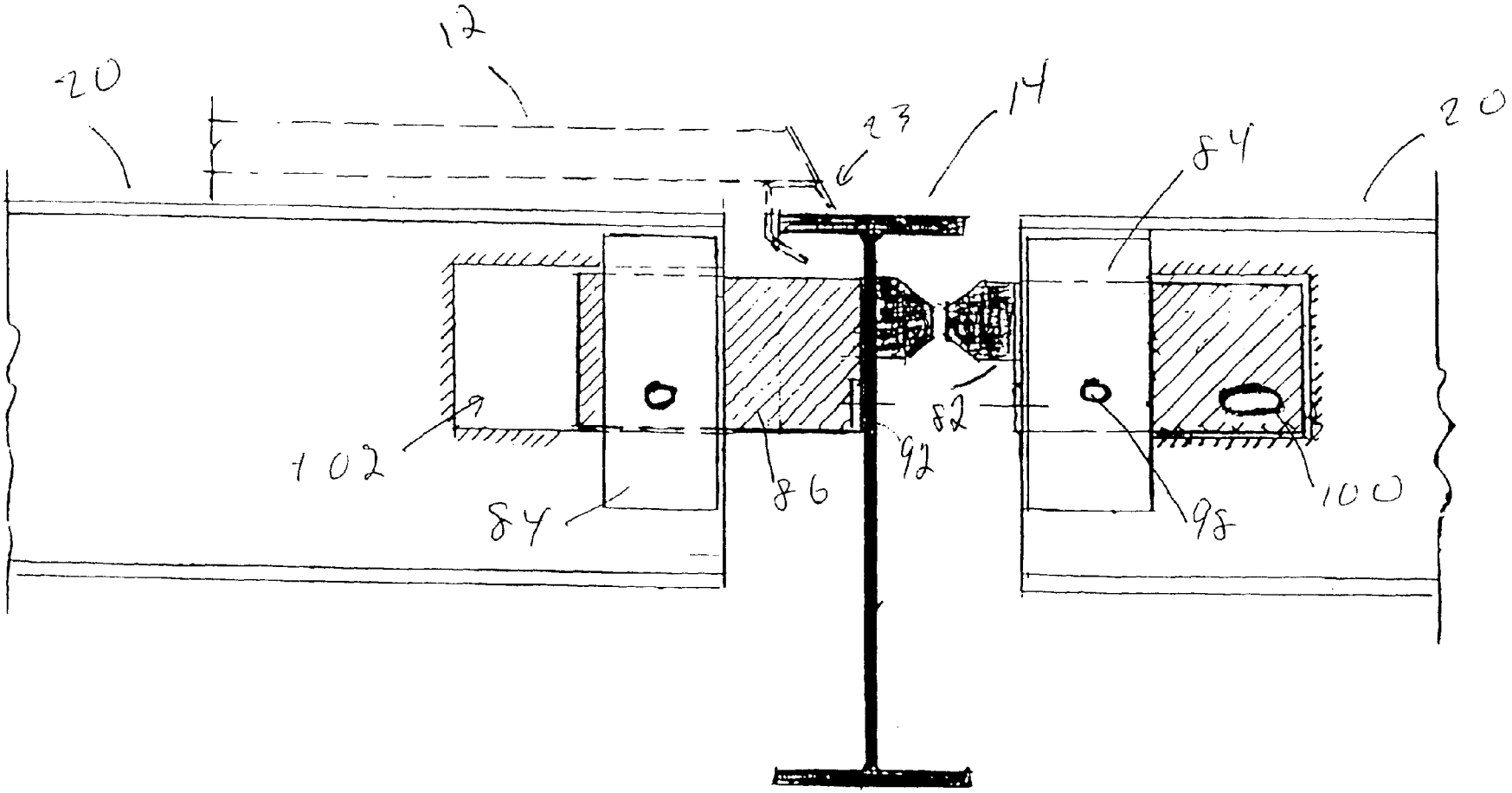
FIG. 6 is a side elevational view of two shoring beams having one version of a first latch device attached at one end of each beam, one first latch device at left shown fully extended and connected to a permanent building girder, with the second first latch device on the right shown fully contracted.

The left portion of FIG. 6 shows a horizontally movable shear plate 86 fitted into a standard steel shoring beam 20. Webbing has been removed, creating a space 102 to allow the shear plate 86 to slide forward or backward in a horizontal direction parallel to the top and bottom chords of the beam. Capture plates 84 are affixed to one end of the shoring beam 20 in a similar fashion to that described above for connection to an end of a shoring girder 18. The latch 82 is shown in forward position connected to the pre-cut latch receiving hole 94 in the girder 14 and the tab plate 92 ready to be secured to the girder web. A similarly modified shoring beam is depicted on the right side of FIG. 6, showing the shear plate 86 in a retracted position for installation or removal.

Figure 7:
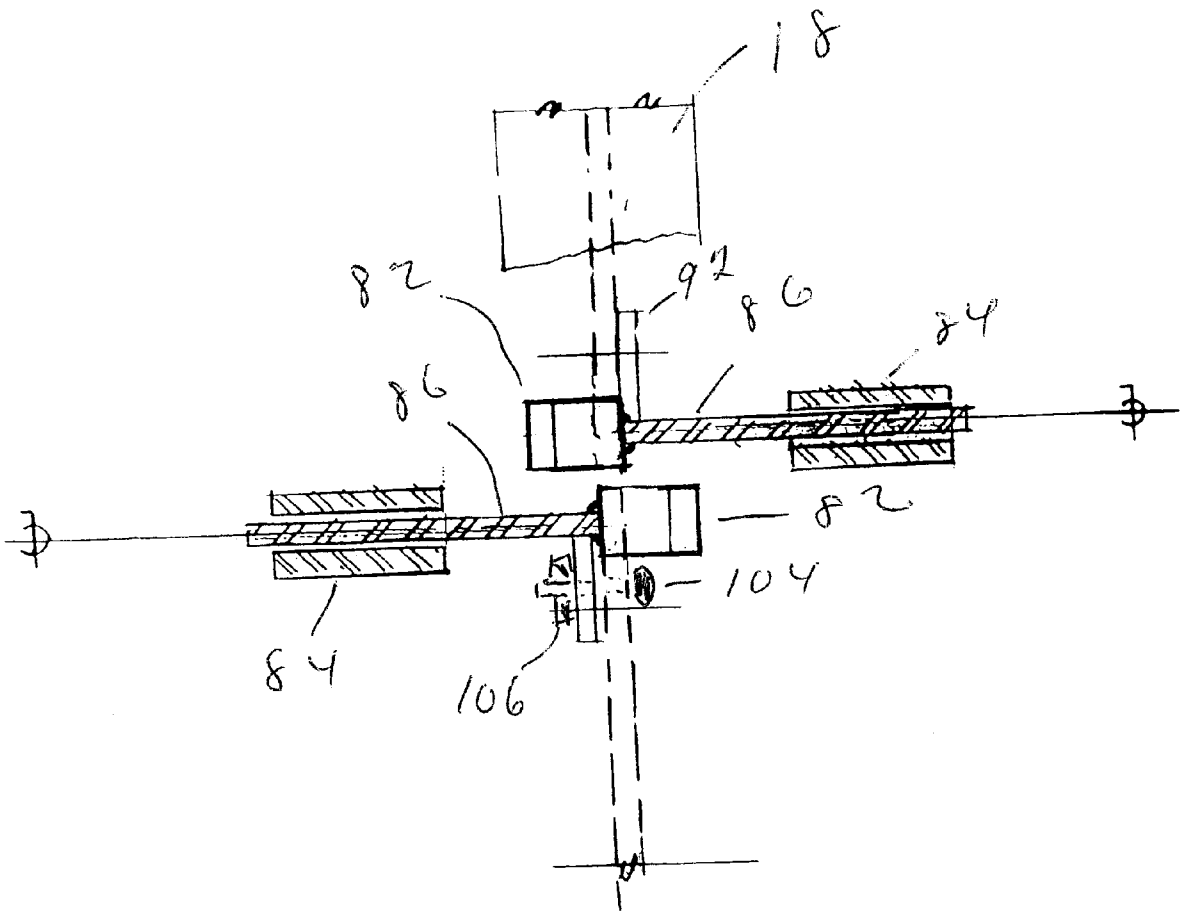
FIG. 7 is a top plan, schematic view of two first versions of the latch device of the invention shown fully extended and connected to a shoring girder.

In FIG. 7 two latch devices 80 are shown as being connected to the web section of a supporting member 18 from opposite sides. In this removable concrete slab support system all members supporting removable shoring members have pre-cut latch receiving holes 94 and bolt holes 96 fabricated in their webs to allow the latches 82 to penetrate and bear on the supporting webs and to allow for bolting the tab plate 92 to the web. The latch receiving holes in the web are sized to accept two latches. Facing the opening 94 from the shoring beam (or girder) side the latch is always positioned to the right side of the opening in order to minimize confusion by providing uniformity during the erection procedure, and, uniformity on the positioning of the tab plate securing bolts 104. Referring to FIG. 1, this positioning of the latch to one side results in the skewing of the members as reflected by the center lines 55 and 57 of respective shoring girders and shoring beams 18 and 20. The center or middle points 55A and 57A of each shoring member is in its true "center" position in the beam-girder support system. In this view the lower of the two latches is shown fully secured to a shoring girder web, with nut 106 securing bolt 104 to the tab plate 92 and shoring girder web.

Figure 8:
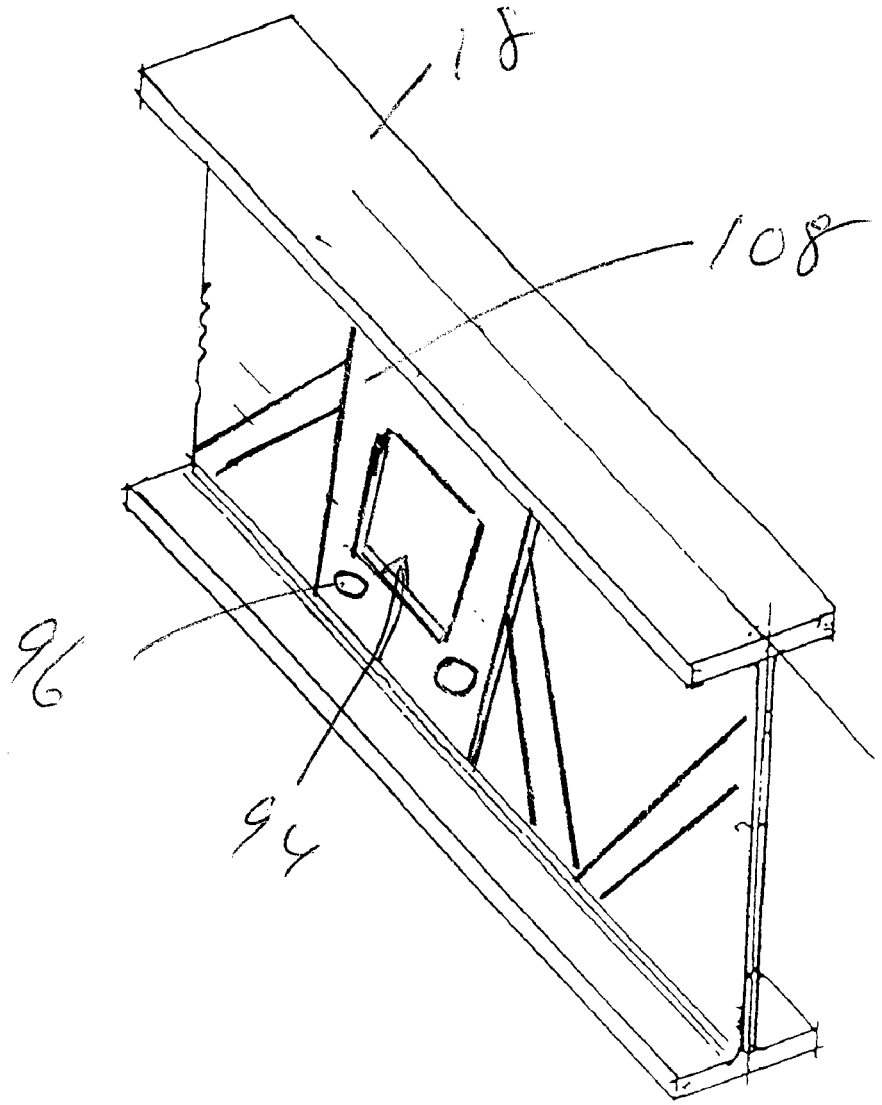
FIG. 8 is a side elevational view of a shoring girder with a latch receiving plate attached.

As shown in FIG. 8, when the supporting member is another shoring joist girder 18 instead of a beam, a web plate 108 with an appropriate latch receiving hole 94, and tab plate securing bolt holes 96 is fabricated in the shoring girder web angles 19 forming the web of this support members so as to be able to receive the latches from each side.

Figure 9:
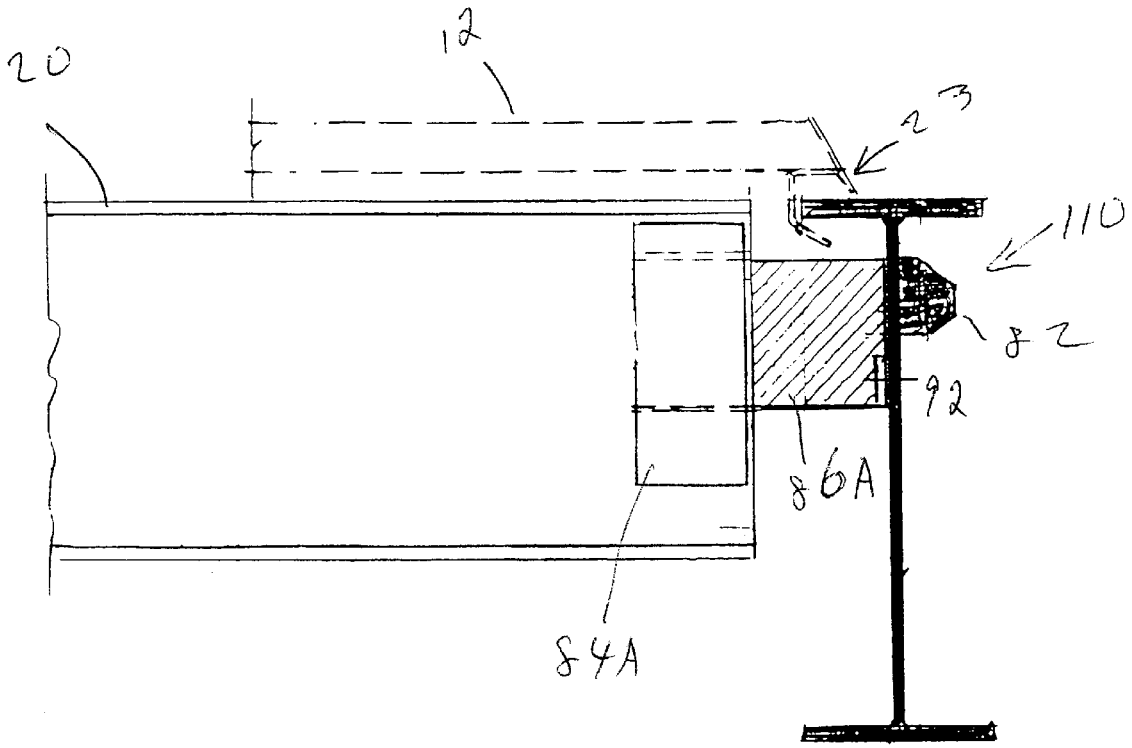
FIG. 9 is a side elevational view of a second version of the latch device of the invention, the latch shown fully extended and connected to a permanent building girder, with a corrugated deck and bearing shoe shown in phantom.
Figure 10:
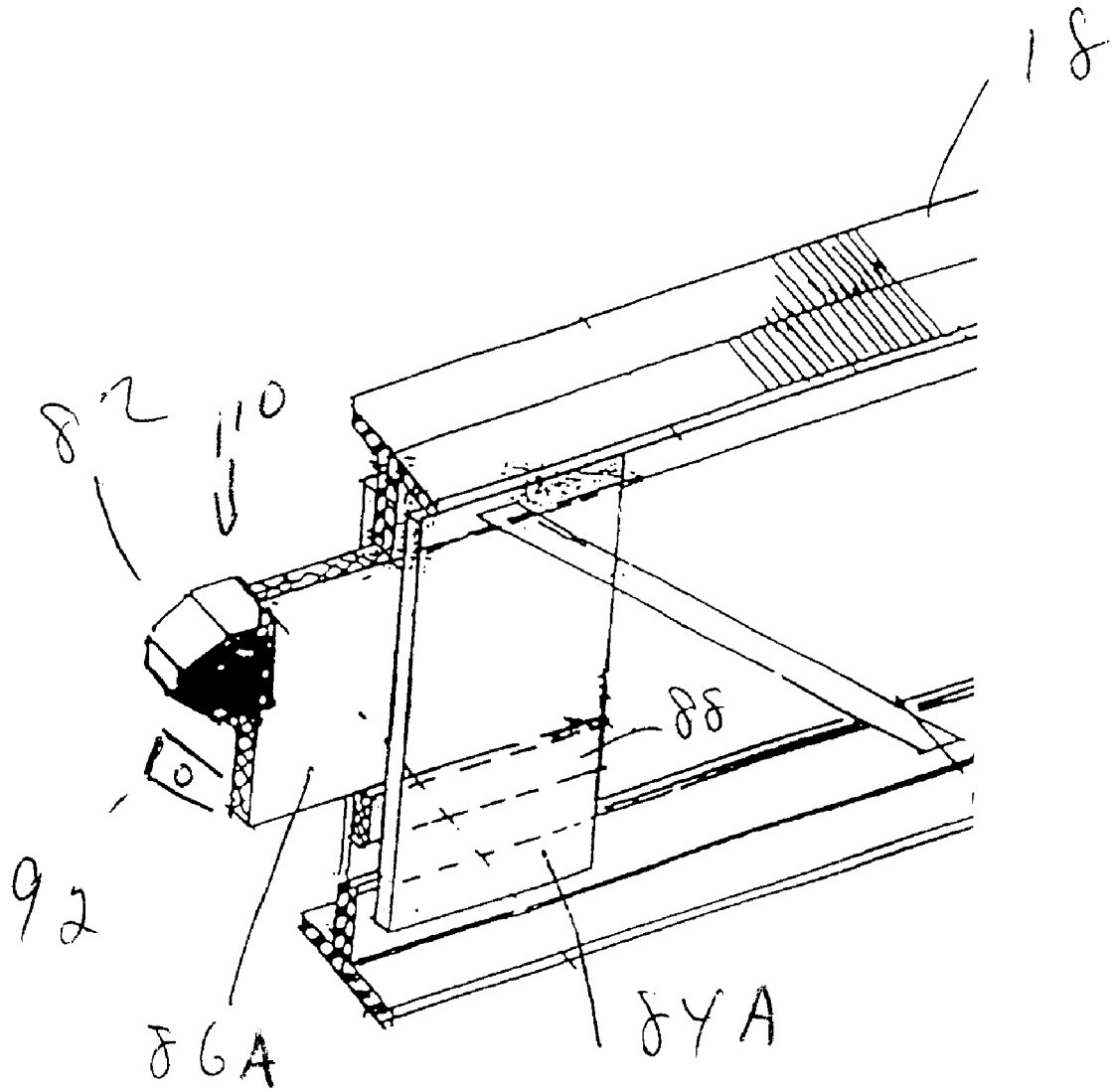
FIG. 10 is an end view of a shoring girder with a second version of the latch device of the invention secured at one end of the girder.

FIGS. 9 and 10 illustrate a second version 110 of the latch device of the invention. For many applications it would be possible to have one latch device fixed in place, and only one adjustable. In FIG. 9 one end of a shoring beam 20 is shown with a fixed in place latch device 110, and similarly in FIG. 10 a shoring girder 18 is shown with a fixed in place latch device 110. Bolt holes 98 in the capture plates are eliminated, as is the slotted hole 100 in the shear plate, the shear plate 86A and capture plate 84A being fixed in place by welding or other suitable means for securing the latch device to the ends of shoring members.

The above described latch devices offer a number of unique advantages:

(1) The latch is directly inserted into a latch receiving hole for erection without any further adjustments being required.

(2) To remove the latch the restraining bolts are removed, and the latch is retracted by hammering from the opposite side or by prying it from the tab side. Once the latch moves beyond the flat section of the supporting member web, the sloped end surfaces aid in removing the latch and dropping the shoring members.

(3) The adjustable length of the latch devices eliminates the requirements for exacting shoring member dimensions.

(4) The adjustable latch devices eliminate the necessity for shims between supporting beams and shoring members.

(5) An adjustable latch at one end of a shoring member usually permits the utilization of a fixed latch device at the other end of a shoring member, which significantly shortens time for both installation and removal.

Figure 11:
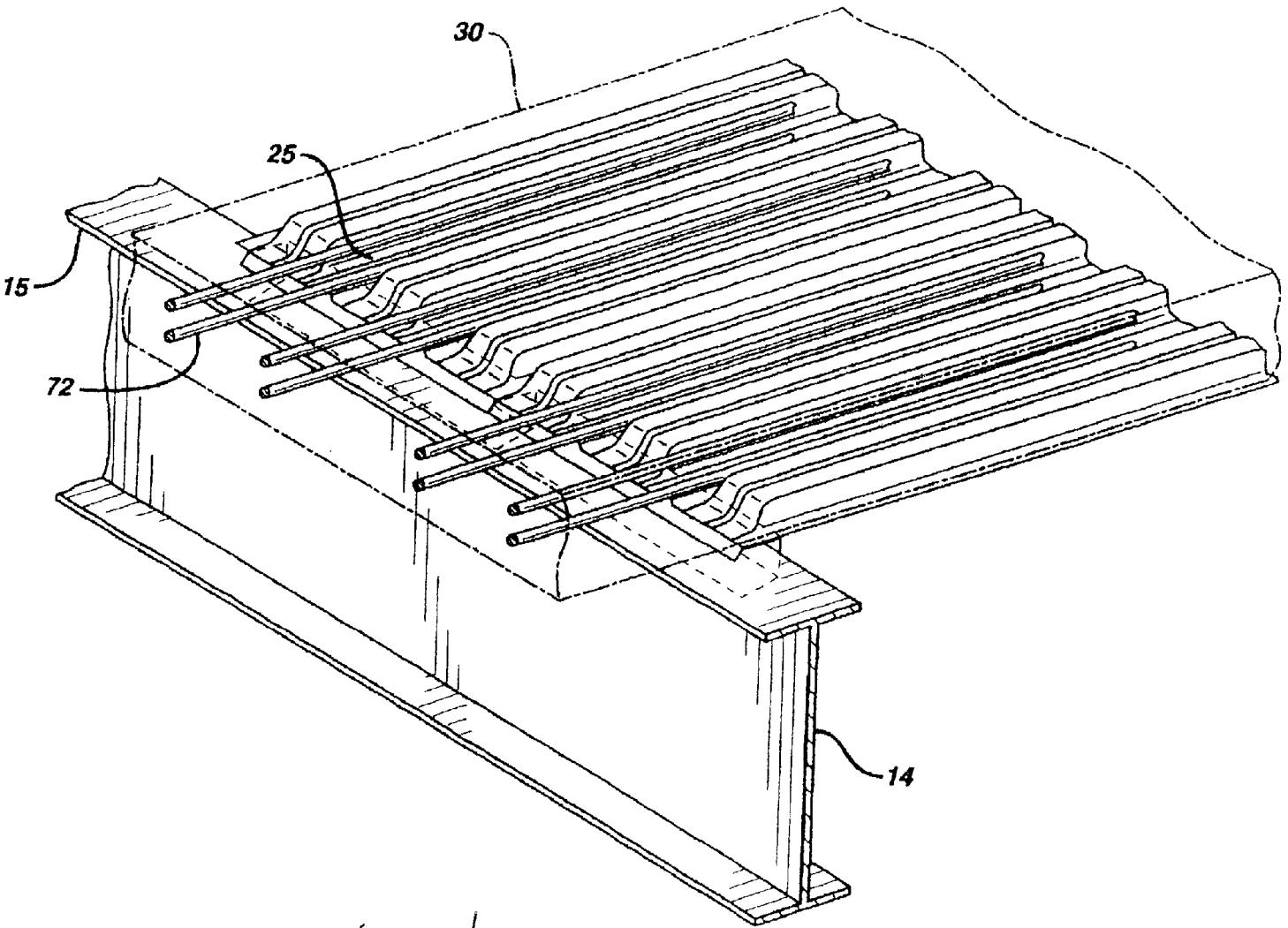
FIG. 11 is a schematic representation of an end portion of a concrete slab supported by the removable support structure of one version of the invention, illustrating the placement of post tensioning steel tendons within the furrows of the corrugated decks.

FIG. 11 illustrates a unique advantage of the structure and method of the invention for those applications in which steel tendons 72 are employed to post tension a concrete slab. When corrugated decks are placed parallel to the permanent building girders and columns, as is typically the case in prior technology, the steel tendons, which need to be placed perpendicular to the permanent girders and columns, can only be placed above the furrows of the decks. Since the present invention calls for the placement of the decks perpendicular to the building girders and columns, it is now possible to place steel tendons within the furrows in the decking thus providing the same strength with a thinner deck. For example, the thickness of the shoring beams 20 can be reduced using additional layers of plywood or raising the location of the latch receiving hole 94 in shoring girders. When the concrete hardens, the post-tensioning effect is enhanced thereby increasing the structural strength of the deck.

After the wet concrete has been poured and then permitted to harden, and the post-tensioning effected, the weight of the system is now supported by the permanent structure. The removable support structure is now taken down with heretofore unobtainable ease and convenience, ready for re-use. The temporary bolts 96 are removed from the bolt holes in the beam, building girder or column. The shoring girder or beam is raised slightly to free the latch. The shoring girder or beam is now free to be moved to the right or left for easy removal. Similar actions at each shoring girder or beam, latch mechanism release these support structures for rapid removal. The straps at the open end of the decks can now be grasped and pulled downward to facilitate the downward motion of the bearing shoes 23 at the building girder or column supported ends of the decks. This motion causes the bearing shoes to break clear of the concrete at the supported end of the deck, with the complete corrugated deck now being free of the concrete slab, in condition for re-use.

While the present invention has been disclosed in connection with versions shown and described in detail, various modifications and improvements will become readily apparent to those skilled in the art. Accordingly, the spirit and scope of the present invention is to be limited only by the following claims.

What is claimed is:

1. A removable support structure for supporting a wet concrete pour and cure during concrete slab construction, said slab disposed between permanently disposed building girders and columns, said removable support structure comprising:

(a) shoring girders, each said shoring girder having a first and second end;

(b) first latch engaging means, said first latch engaging means for removably engaging at least one of said first and second ends of each said shoring girder to a respective first one of either said building girders or columns, said shoring girders for extending from said respective first one of either said building girders or columns to a respective second one of either said building girders or columns, to which said second end of said shoring girder is to be engaged, said first latch engaging means having means for being extended or retracted a spaced distance from or towards said at least one of said first and second ends of each said shoring girders;

(c) shoring beams, each said shoring beam having a third and fourth end;

(d) second latch engaging means, said second latch engaging means for removably engaging at least one of said third and fourth ends of each said shoring beam to a respective shoring girder, each said second latch engaging means including means for being extended or retracted a spaced distance from or toward said at least one of said third and fourth ends of each said shoring;

(e) a plurality of deck members for supporting the wet concrete until it hardens, each of said deck members for being positioned between said respective first one of either said building girders or columns and said respective shoring beam, or between said respective shoring beam and said respective second one of either said building girders or columns, each said deck member having a fifth and sixth end, each said deck member for being supported at said fifth end by said respective first or second one of said building girders or columns and at said sixth end by said respective shoring beam;

(f) first cooperating means for being disposed between said fifth end of each said deck member and said respective first or second one of said building girders or columns and for detachably engaging said fifth end to said respective first or second one of said building girders or columns each said first cooperating means for detachably engaging including means for permitting rotation of said respective deck member downward, to facilitate removal of each said deck member; and, (g) second cooperating means disposed at said sixth end of each said deck member, said second cooperating means including means cooperatively engaging each said sixth end of respective deck members, said second cooperating means further including means utilized by an operator to initiate downward rotational movement of each said deck member at said sixth end, to facilitate removal of said sixth end from the concrete after it hardens;

said first and second latch engaging means and said first and second cooperating means permitting rapid engagement and/or subsequent rapid removal of the elements of said support structure, before the pouring of the wet concrete and after the hardening thereof, respectively, and thereafter the reuse of said support structure elements to support a subsequent concrete slab construction.

2. The removable support structure claimed in claim 1 wherein the elements comprising said support structure are adapted to be disposed substantially in a plane defined by the respective first and second one of said building girders to which said shoring girders are to be engaged by said first latch engaging means.

3. The removable support structure system claimed in claim 1 wherein said deck members are corrugated in that they have alternating high segments and furrows.

4. The removal support structure claimed in claim 3, further comprising steel tendons, said steel tendons being placed along the length of said deck members, and, within said furrows in said corrugated deck members prior to the pouring concrete.

5. The removable support structure claimed in claim 1 wherein said first cooperating means comprises a respective bearing shoe being affixed to said fifth end of a first deck member to be supported by said respective first one of either said building girders or columns, with the sixth end of said first deck member being supported on a top surface of said respective shoring beam, said sixth end of said first deck member overlapping a sixth end of a second deck member, said first and said second deck members being secured together by at least one strap, a respective bearing shoe affixed to said fifth end of said second deck member and for being supported by said respective second one of either said building column or columns, so that in addition to said first and second decks being firmly and accurately secured together, said at least one strap cooperates with each said bearing shoe to firmly and accurately engage said bearing shoe against an extending edge of a top flange or plate of its said respective first or second one of said supporting building girders or columns.

6. The removable support structure claimed in claim 5 wherein said bearing shoe comprises a channel affixed along the width of said fifth end of each said deck member to be supported by said respective first or second one of said building girders or columns, said channel for engaging said extending edge of said top flange or plate of said respective first or second one of said building girders or columns when said deck member is positioned between said respective first or second one of said building girders or columns and said shoring beam.

7. The removable support structure claimed in claim 5 wherein said at least one strap additionally engages a top surface of said respective shoring beam.

8. A removable support structure for supporting wet concrete between permanently positioned building girders and columns during concrete slab construction, comprising:

shoring girders having an horizontally adjustable first latch mechanism at a first end and a fixed in place second latch mechanism at a second end of said shoring girders, said first latch mechanism comprising a first shear plate with a latch secured to one end of said shear plate, said latch facing away from said first end of said shoring girder, said first shear plate having a tab plate containing a bolt hole affixed at the same end of said first plate to which said latch is affixed, a first space within a web portion of said first end of said shoring girder, said first shear plate being positioned within said first space, a pair of first capture plates, each one of said first capture plates being affixed to said web at opposite sides of said first shear plate, means for securing said first capture plates to said first shear plate so as to permit horizontal movement of said first shear plate within said first space in said web portion, in order that said latch may be extended forward and away from or retracted towards said first end of said shoring girder as circumstances require, said means for securing said first capture plates/shear plate being activated after said horizontal movement as said circumstances required;

said fixed in place second latch mechanism being similar in fabrication to said horizontally adjustable first latch mechanism, comprising a second pair of capture plates, a second shear plate, a latch affixed to said second shear plate, a tab plate containing a bolt hole affixed to said second shear plate at the same end as said latch is affixed, a second space within said web portion for positioning said second shear plate, said second capture plates and said second shear plate being permanently affixed in place;

shoring beams having said first and second latch mechanisms affixed at each end of said shoring beams, said shoring beams being positioned between and at a substantially right angle to said shoring girders, said latches at said ends of each said shoring beam for engaging pre-cut openings in said web portion of said shoring girders;

corrugated deck members for being supported by a respective said building girder or column and a respective said shoring beam, at least two of said deck members having closed upraised ridge portions at respective ends of said deck members which are for being supported on said respective building girder or column, said building girder or column supported deck member end being further modified with a channel affixed thereto along the width thereof so as to firmly encompass an extending edge of a top flange or plate of said building girder or column, said at least two said deck members having open, upraised ridge portions at their respective other ends supported by a respective said shoring beam, said respective other open, upraised portion deck member ends of said at least two said deck members overlapping each other on a top surface of said respective shoring beam, said overlapping open ends of said deck members being removably secured together by at least one strap, said strap cooperating with said channels on said deck members so as to firmly and accurately secure said deck members in a manner to resist movement due to workers and the elements prior to pouring of said wet concrete onto the top surface of said corrugated deck members;

said shoring girders, shoring beams, and corrugated deck members being removed in re-usable condition from said concrete slab construction after said concrete has hardened by hammering and prying said latches free of said pre-cut openings, enabling removal of said shoring girders and said shoring beams from said hardened concrete, and bending said at least one strap on said shoring beam supported ends of said deck members downward, enabling removal of said deck members by rocking said deck members in a downward direction.

9. The removable support structure claimed in claim 8, further comprising steel tendons, said steel tendons being placed along the length of said deck members within the furrows in said deck members.

10. A method for providing a removable support structure for concrete slab construction, comprising the steps of:

(a) securing shoring girders at right angles to oppositely positioned permanent building wall supports making use of horizontal length adjustable latches affixed at at least one end of each of said shoring girders for engagement of pre-cut openings in said wall supports;

(b) securing respective shoring beams to said shoring girders, each of said shoring beams being positioned between and at right angles to two shoring girders, said shoring beams being secured to said shoring girders making use of said horizontal length adjustable latches as affixed to said shoring girders, being affixed at at least one end of each of said shoring beams for engagement of pre-cut openings in said shoring girders;

(c) placing corrugated deck members on top surfaces of said wall supports and said shoring beams so as to span an open building area between said wall supports, said corrugated deck members being positioned lengthwise perpendicularly to said wall supports;

(d) securing one end of each of said deck members to at least one other end of another deck member by means of at least one strap, said strap secured ends of said deck members being positioned on said top surface of said shoring beam;

(e) securing an end of said deck members positioned on said top surface of said wall support to an extended top edge of said wall support top surface making use of a channel along the width of said end of said deck members positioned on said wall support, said channel engaging said top edge of said top surface of said wall support;

(f) pouring wet concrete onto a top surface of said corrugated deck members;

(g) allowing said wet concrete to harden; and (h) removing said shoring girders, said shoring beams, and removing said corrugated deck members by rotating downwards said ends of said deck members secured to each other by said at least one strap, said deck members pivoting downward about the end of each said deck member secured to the top surface of said wall support in re-usable condition after said concrete has hardened.

11. The method according to claim 10, further comprising the step of placing steel tendons along said length of said deck members, said steel tendons being placed within furrows in said deck members.

12. A removable support structure for supporting a wet concrete pour and cure during concrete slab construction, said slab disposed between permanently disposed building girders and columns, said removable support structure comprising:

(a) shoring girders, each said shoring girder having a first and second end;

(b) first latch engaging means, said first latch engaging means for removably engaging at least one of said first and second ends of each said shoring girder to a respective first one of either said building girders or columns, said shoring girders for extending from said respective first one of either said building girders or columns to a respective second one of either said building girders or columns, to which said second end of said shoring girder is to be engaged, said first latch engaging means having means for being extended or retracted a spaced distance from or towards said at least one of said first and second ends of each said shoring girders;

(c) shoring beams, each said shoring beam having a third and fourth end;

(d) second latch engaging means, said second latch engaging means for removably engaging at least one of said third and fourth ends of each said shoring beam to a respective shoring girder, each said second latch engaging means including means for being extended or retracted a spaced distance from or toward said at least one of said third and fourth ends of each said shoring beam;

(e) a plurality of deck members for supporting the wet concrete until it hardens, each of said deck members for being positioned between said respective first one of either said building girders or columns and said respective shoring beam, or between said respective shoring beam and said respective second one of either said building girders or columns, each said deck member having a fifth and sixth end, each said deck member for being supported at said fifth end by said respective first or second one of said building girders or columns and at said sixth end by said respective shoring beam;

(f) first cooperating means for being disposed between said fifth end of each said deck member and said respective first or second one of said building girders or columns and for detachably engaging said fifth end to said respective first or second one of said building girders or columns each said first cooperating means for detachably engaging including means for permitting rotation of said respective deck member downward, to facilitate removal of each said deck member; and, (g) second cooperating means disposed at said sixth end of each said deck member, said second cooperating means including means cooperatively engaging each said sixth end of respective deck members, said second cooperating means further including means utilized by an operator ti initiate downward rotational movement of each said deck member at said sixth end, to facilitate removal of said sixth end from the concrete after it hardens;

said first and second latch engaging means and said first and second cooperating means permitting rapid engagement and/or subsequent rapid removal of the elements of said support structure, before the pouring of the wet concrete and after the hardening thereof, respectively, and thereafter the reuse of said support structure elements to support a subsequent concrete slab construction, wherein said first and second latch engaging means include a respective latch mechanism adapted to engage means for supportingly, accommodating said respective latch mechanism to be disposed on said respective first or second one of said building girders, columns or said respective shoring girder, and, wherein each said respective latch mechanism comprises a shear plate with a latch secured to one end of said shear plate, said latch facing away from said at least one end of said shoring girder or shoring beam, said shear plate having a tab plate containing a bolt hole secured at an end portion of said shear plate to which said latch is affixed; a space wherein said shear plate is positioned, said space being within a web portion of said at least one end of said shoring girder and shoring beam, a pair of capture plates, each one of said capture plates being affixed to said web at opposite sides of said shear plate, means for securing said capture plates to said shear plate so as to permit horizontal movement of said shear plate within said space in said web portion in order that said latch may be extended forward and away from or retracted towards said one end of said shoring girder or shoring beam as circumstances require, said capture plate/shear plate securing means being employed to secure said capture plate and said shear plate after said extension or retraction shear plate adjustments have been performed to accommodate said circumstances, so that when said latch is connected to a pre-cut opening in said means for supportingly accommodating said respective latch mechanism, a tab bolt and tab nut secure said hole in said tab plate to a matching hole in a web portion of one of said building girders, columns, shoring girders, or shoring beams, thereby securing said latch to said means for accommodating said respective latch mechanism, and when it is desired to release said shoring girders and said shoring beams from said concrete slab construction said tab bolt and said tab nut are removed from said hole in said tab plate and said matching hole in said web portion, and said latch is hammered or period out of said pre-cut opening, thereby releasing said latch for removal from said shoring support member.

* * * * *

UNITED STATES PATENT AND TRADEMARK OFFICE

CERTIFICATE OF CORRECTION

PATENT NO. : 6,390,438 B1
DATED : May 21, 2002
INVENTOR(S) : Ira J. McManus

It is certified that error appears in the above-identified patent and that said Letters Patent is hereby corrected as shown below:

Column 9,
Line 54, insert the word -- beam -- after the word "shoring".

Column 14,
Line 51, change the word "period" to the word -- pried --.

Signed and Sealed this

Fifteenth Day of October, 2002

*Attest:*

*Attesting Officer*

JAMES E. ROGAN
*Director of the United States Patent and Trademark Office*